US011774087B1

(12) United States Patent
Singh et al.

(10) Patent No.: US 11,774,087 B1
(45) Date of Patent: Oct. 3, 2023

(54) LAMP WITH VERTICAL TRAVEL FOR SECURITY

(71) Applicants: Edward G. Singh, La Mirada, CA (US); Steve Castro, La Habra, CA (US); James Edward Grimes, Yorba Linda, CA (US); Qilang Chen, Longgang Town (CN)

(72) Inventors: Edward G. Singh, La Mirada, CA (US); Steve Castro, La Habra, CA (US); James Edward Grimes, Yorba Linda, CA (US); Qilang Chen, Longgang Town (CN)

( * ) Notice: Subject to any disclaimer, the term of this patent is extended or adjusted under 35 U.S.C. 154(b) by 0 days.

(21) Appl. No.: 17/390,058

(22) Filed: Jul. 30, 2021

(51) Int. Cl.
*F21V 33/00* (2006.01)
*F21W 131/30* (2006.01)

(52) U.S. Cl.
CPC ..... *F21V 33/0004* (2013.01); *F21W 2131/30* (2013.01)

(58) Field of Classification Search
CPC ..... E04H 15/10; E05G 1/005; E05G 1/06; F21V 21/145; F21V 27/005; F21V 33/0004; F21W 2131/30
See application file for complete search history.

(56) References Cited

U.S. PATENT DOCUMENTS 10,577,822 B1 * 3/2020 Singh ..... E05G 1/005
2007/0091594 A1 * 4/2007 Soon ..... F21S 9/037 362/183

* cited by examiner

*Primary Examiner* — Leah Simone Macchiarolo
(74) *Attorney, Agent, or Firm* — Patent Law & Venture Group LLC; Gene Scott

(57) ABSTRACT

A lamp for securing items has a pair of vertically separable enclosure portions joined by coiled flexible bands. The flexible bands are operated by an electro-mechanical drive to uncoil and to recoil, thereby first separating the enclosure portions and later rejoining them. A lower one of the enclosure portions has an interior storage space for receiving and securing items such as watches, cellphones, and wallets. The lamp is mounted on the bottom of the lower portion of the enclosure so as to direct its light beam downwardly. A control device enables remote operation of the drive and the lamp. The enclosure may be mounted to top trusses of a camping tent or canopy for instance. The camping tent or canopy may be left unoccupied with the assurance that a thief will not know that valuables are present in the lamp and also will not be able to gain access to the interior of the lamp.

18 Claims, 4 Drawing Sheets

LAMP WITH VERTICAL TRAVEL FOR SECURITY

FIELD OF THE DISCLOSURE

The field of this invention relates to lighting devices such as lamps and also to a means for hiding or securing valuables, and more particularly to an apparatus that provides both functions simultaneously.

BACKGROUND

Tents, canopies, and similar portable structures are widely used at campsites, beaches, and along hiking trails for providing shelter, recreation and similar utilization. Recreational activities, such as trips to the beach, often involve setting up personal belongings in a common area and typically under a portable shelter. Often, the belongings must be tied down or otherwise secured to prevent damage or theft. Once belongings have been set up and secured, it is often desirable to leave them unattended for a period of time, as for instance, to go swimming or hiking. Clearly when valuables are left unattended they are subject to theft. To ensure safekeeping, it is desirable to store valuables in a secure manner where they cannot be stolen or damaged. Accordingly, it is desirable to produce a portable device or apparatus that provides a secure storage space for safekeeping personal items. In this instance such a device must be securely attached to physical members of physically structured structures. Another possibility is to hide valuables in a place that appears to have an alternate purpose so mislead a thief. Such items are well-known such as the hollow garden rock where a house key or other item may be hidden and the hollow rock appears to be just one of several present. The prior art teaches other solutions of this kind such as the lantern with a detachable accessory compartment.

BRIEF DESCRIPTION OF THE INVENTION

The invention apparatus has a dual purpose, that is, as a source of illumination, useful in a camping situation, as well as a means for storing valuables such as documents, wallets, watches, and cell phones. The lamp is mounted in a lower portion of an enclosure which also has a storage space. The enclosure is securely fastened to an overhead support structure such as the upper trusses of a camping canopy or large tent so that it is generally out-of-reach. An upper portion of the enclosure has a battery powered electrical circuit capable of operating a mechanical drive for unwinding and rewinding coiled bands which are attached between the lower and upper portions of the enclosure so as to drop the lower portion to table-top level whereupon valuables may be placed therein. The lower portion of the enclosure may then be raised and recoupled with the upper portion forming a closed unitary apparatus that appears to be a simple lamp. The lamp which is mounted on the downfacing surface of the lower portion is powered by a separate battery pack which provides downcast illumination. The electrical circuit may be modified to include common and well-known motion and attitude detection components to warn unwanted intruders Clearly all functions, as described, may be managed by a hand-held remote control device using blue-tooth or other types of signaling. Preferably, a remote control pass code may be entered in order to operate certain features of the invention, as for instance, lowering and raising the lower portion of the enclosure thereby enabling access to a storage area within for placing and removing items. As an operational back-up in case of remote control failure or battery failure a manual lock and key feature is incorporated in the invention in order to gain access to the storage area. It should be realized that battery power is incorporated separately in both the upper and the lower portions of the enclosure to power their respective functions.

DESCRIPTION OF THE DRAWING

Embodiments shown in the drawing figures are illustrated only as examples associated with the accompanying written description. Alpha-numerical call-outs are used to identify elements of the invention in the drawing figures, wherein a call-out used for a particular element in any drawing view is used for that same element in any other view, wherein.

DETAILED DESCRIPTION OF THE INVENTION

Figure 1:
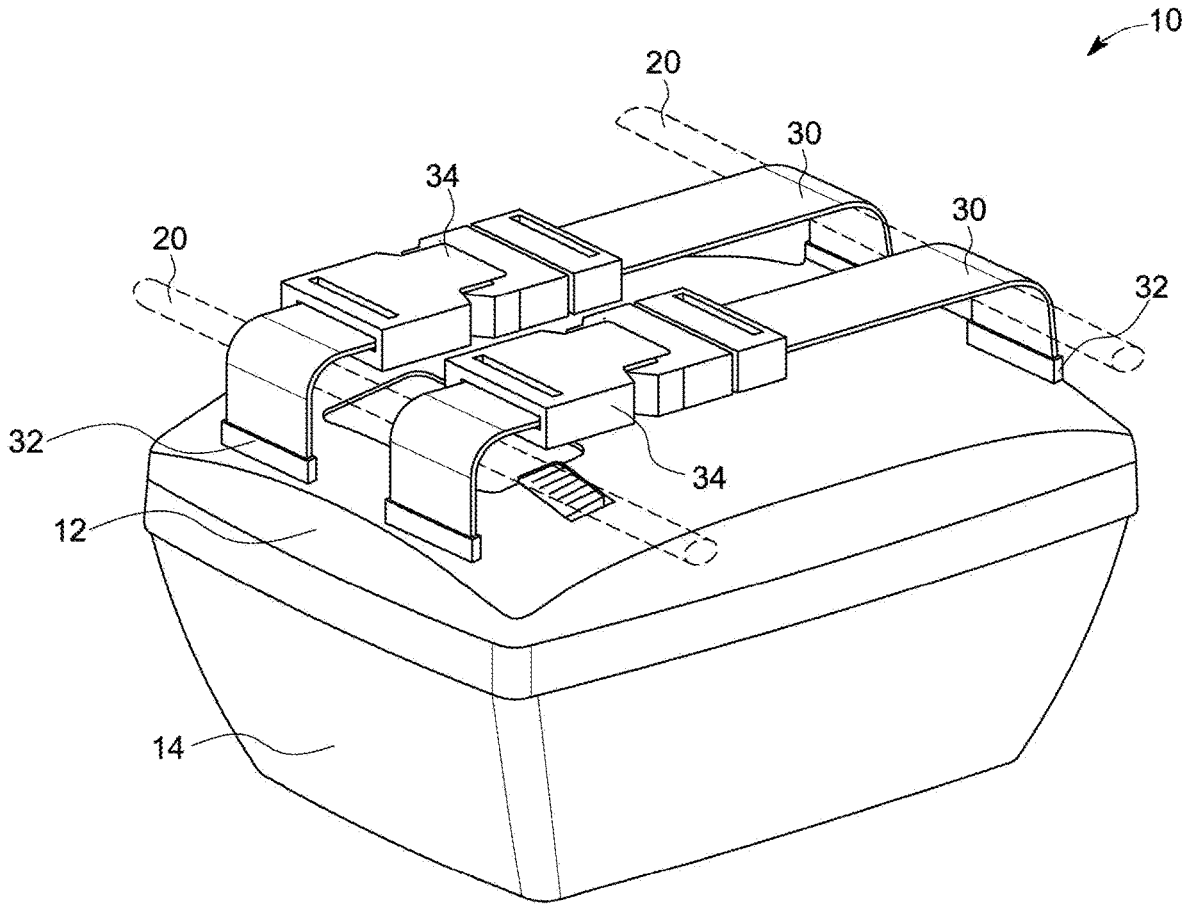
FIG. 1 is a perspective view of described enclosure portions joined to a mounting structure (dashed lines) which mounting structure is not part of the invention.
Figure 2:
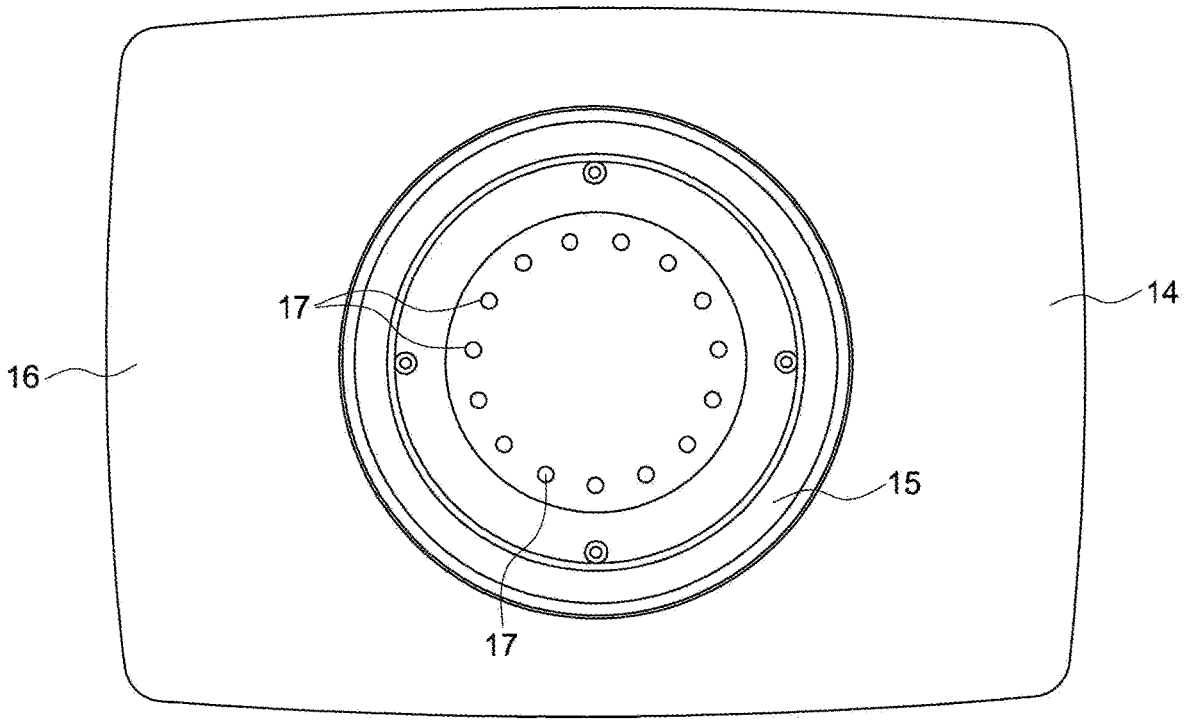
FIG. 2 is a bottom plan view thereof illustrating a lamp mounted to a lower one of the enclosure portions.
Figure 3:
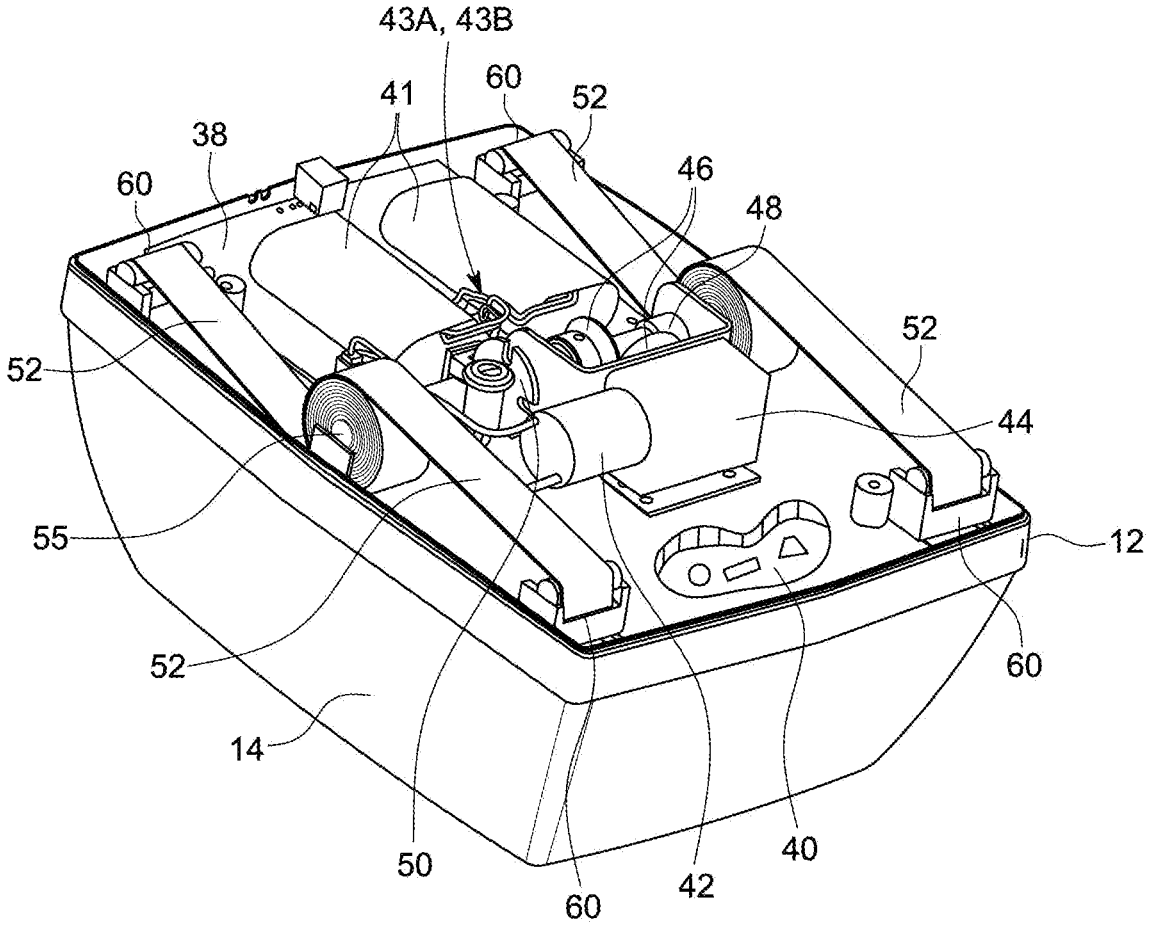
FIG. 3 is a perspective view of the invention shown with a portion removed to reveal operating components within.

FIG. 1 illustrates how the invention (apparatus 10) may be secured to an overhead structure such as trusses 20 shown by dashed lines (not a part of the invention), within a camp tent or canopy (not shown). Apparatus 10 may have an upper enclosure portion 12 that may be engaged with a lower enclosure portion 14. Enclosure portions 12 and 14 may be made of injection molded plastic or other light-weight and thin-walled structural material. Binding means 30 may be fixed at its ends 32 to upper portion 12, and may be provided with common engaging/disengaging elements 34 such as the well known Uxcell™ plastic clasp side release buckle, and may also have integral combination or keyed locks of any commercially offered type, such as is offered by Lockstraps, Inc. of Temecula, Calif. Once secured, as shown in FIG. 1 apparatus 10 can only be removed from trusses 20 by releasing the locks, and therefore may be quite-well secured against theft. FIG. 2 illustrates that a downwardly facing lamp 15 may be mounted in or on the bottom 16 of enclosure portion 14. Lamp 15 may be fitted with low voltage light emitting diodes 17 and may be powered by common batteries (not shown) that may be located within lamp 15 as is very well known in the art. Operating components on chassis 38 are shown in FIG. 3. Described now is one possible means for coiling and uncoiling of bands 52. Chassis 38 may be fixed integrally to upper enclosure portion 12. As shown, operating components may include: batteries 41, worm gear motor 42, gear box 44, bevel gears 46, drive shaft 48, synchronizer disk 50, synchronizer transmitter 43A, synchronizer receiver 43B, and four coiled flexible bands 52. Bands 52 are coiled in pairs and mounted on support axles 55 which are joined to and driven in rotation by drive shaft 48. This action causes bands 52 to uncoil so as to allow lower enclosure portion 14 to move downward by gravity force. Fastened to, and mounted on, the underside of chassis 38 as shown in FIG. 3, is a process controller circuit (controller 40) such as controller model D517352 manufactured by Sunman of Indiana or other common and very well known controller.

Figure 4:
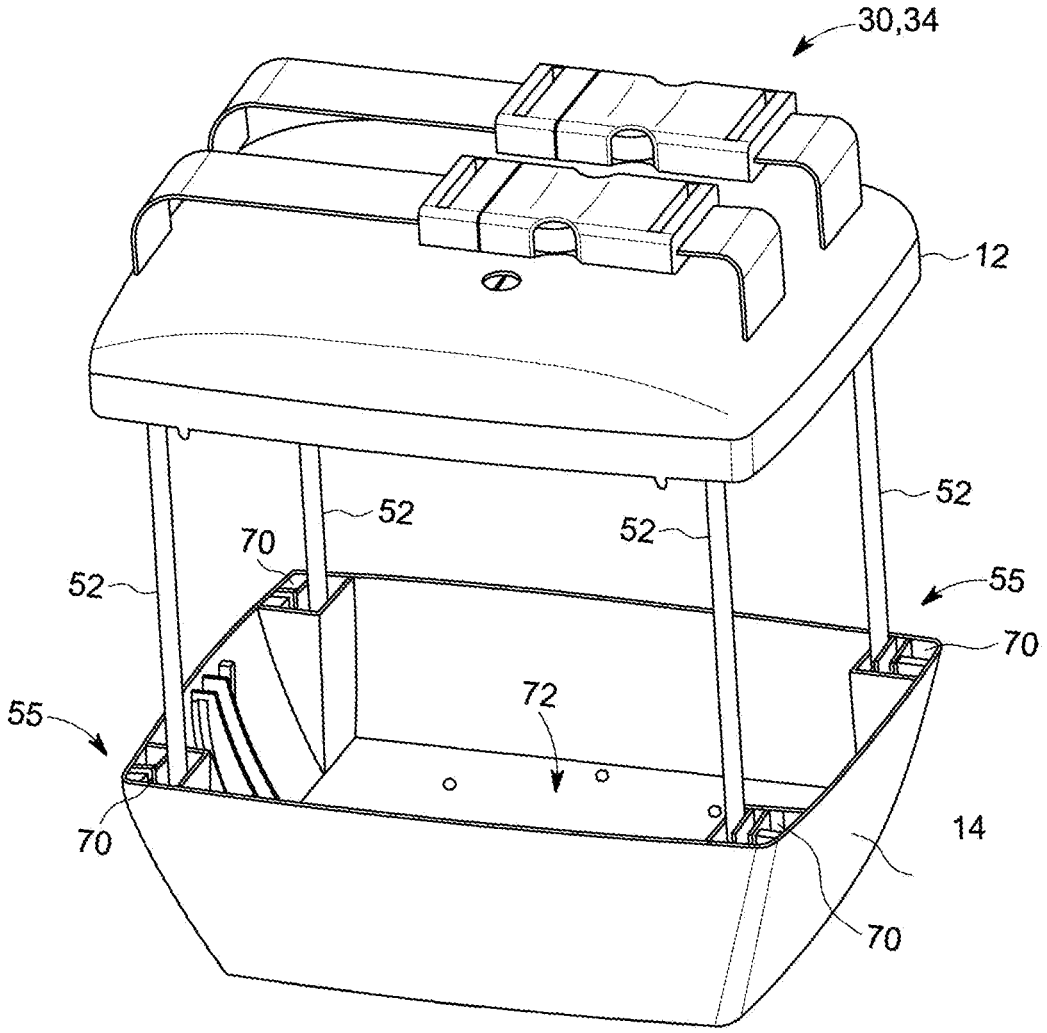
FIG. 4 is a perspective view of the invention shown with the lower enclosure portion suspended by flexible bands from an upper enclosure portion.

The stated and illustrated components or alternatives described herein are well known in the art, however the arrangement of these components and their joint functional operations is novel. Operation of apparatus 10 is preferably initiated via a hand-held remote control generated signal which may be received by controller 40 whereby worm gear motor 42 may be activated driving shaft 48 through bevel gears 46. Synchronizing disk 50 rotates on shaft 48 whereby on each rotation, a slot in disk 50 permits light or other energy signal to travel between synchronizer transmitter 43A and synchronizer receiver 43B whereby synchronizer receiver 43B produces voltage pulses or other electrical change signaling controller 40 to increment a counter (not shown). A memory element (not shown) of controller 40 is calibrated for the total counts required to lower or raise portion 14 for a desired vertical travel. When total counts equal the stored maximum counts in the memory element, travel of lower enclosure portion 14 is halted. Enclosure portions 12, 14 may have mechanical, magnetic or other proximity sensors as is well known in the art for location termination or disposition upon coupling. Once the designated travel of enclosure portion 14 has been completed, worm gear 42 is halted and the memory element of controller 40 is set to zero. FIG. 4 illustrates the separation of enclosure portions 14 from portion 12. Flexible bands 52 are fastened at their ends 55 to clamping fixtures 70. The weight of enclosure portion 14 pulls down on bands 52 as they uncoil as previously described. In this manner enclosure portion 14 is able to drop down from its initial position engaged with upper enclosure portion 12 so as to assume a lowered position for delivering or receiving items within storage space 72. Once items (not shown) have been placed into storage space 72, a signal from a hand-held remote control device starts motor 42 in the reverse rotational sense to thereby draw bands 52 back into upper enclosure portion 12 to resume their previously coiled state. When lower enclosure portion 14 engages upper enclosure portions 12 pogo pins may complete an electrical circuit functional for halting motor 42.

The invention claimed is:

1. A lamp for securing items comprising:

a pair of vertically separable enclosure portions;

said pair of enclosure portions joined by a coiled flexible band;

said coiled flexible band engaged with a means for uncoiling and recoiling;

whereby at least one of said pair of enclosure portions has an interior storage space for receiving said items; and said lamp is positioned for directing downwardly casted illumination.

2. The lamp for securing items of claim 1 wherein said flexible band comprises plural bands.

3. The lamp for securing items of claim 1 wherein said flexible band comprises four flexible bands engaged with said enclosure portions.

4. The lamp for securing items of claim 1 further comprising a means for binding secured to one of said pair of enclosure portions.

5. The lamp for securing items of claim 4 wherein said means for binding has a security feature.

6. The lamp for securing items of claim 1 wherein said means for uncoiling and recoiling is an electro-mechanical drive.

7. The lamp for securing items of claim 6 wherein said electro-mechanical drive comprises at least an electric motor, a drive shaft, a rotation counter, and a process controller.

8. A method for securing items comprising:

engaging an upper and a lower portions of an enclosure by a flexible band;

engaging said flexible band with a means for uncoiling and recoiling;

incorporating a storage space within at least one of said enclosure portions; and directing illumination in a preferred direction from a lamp in said enclosure.

9. The method for securing items of claim 8 further comprising joining plural flexible bands between said enclosure portions.

10. The method for securing items of claim 8 further comprising joining four flexible bands between said enclosure portions.

11. The method for securing items of claim 8 further comprising securing a means for binding to one of said enclosure portions.

12. The method for securing items of claim 11 further comprising incorporating a security feature in said binding strap.

13. The method for securing items of claim 11 further comprising fixing said means for binding to said upper one of said enclosure portions.

14. The method for securing items of claim 13 further incorporating a means for engaging and alternately disengaging said means for binding to a fixed structure.

15. The method for securing items of claim 8 further comprising uncoiling and recoiling said band for initially separating said enclosure portions and thereafter joining said enclosure portions.

16. The method for securing items of claim 15 wherein said uncoiling moves said lower portion of said enclosure downward.

17. The method for securing items of claim 16 wherein said items are deposited into and alternately removed from said lower portion.

18. The method for securing items of claim 15 wherein said recoiling moves said lower portion of said enclosure upward.

* * * * *